US012571307B2

(12) United States Patent
Anifowose et al.

(10) Patent No.: US 12,571,307 B2
(45) Date of Patent: Mar. 10, 2026

(54) SYSTEM AND METHOD FOR PREDICTING WELL CHARACTERISTICS

(71) Applicant: SAUDI ARABIAN OIL COMPANY, Dhahran (SA)

(72) Inventors: Fatai A. Anifowose, Al-Khobar (SA); Maimona Washie, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 503 days.

(21) Appl. No.: 18/170,973

(22) Filed: Feb. 17, 2023

(65) Prior Publication Data

US 2024/0280017 A1 Aug. 22, 2024

(51) Int. Cl.
*E21B 49/08* (2006.01)

(52) U.S. Cl.
CPC ..... *E21B 49/088* (2013.01); *E21B 2200/20* (2020.05); *E21B 2200/22* (2020.05)

(58) Field of Classification Search
CPC .... E21B 49/088; E21B 49/00; E21B 2200/20; E21B 2200/22; E21B 2200/00; G01V 11/00
See application file for complete search history.

(56) References Cited

U.S. PATENT DOCUMENTS 11,880,776 B2 * 1/2024 Shan ..... G06N 3/08
2018/0100390 A1 4/2018 Patil et al.
2018/0347354 A1 * 12/2018 Li ..... G06N 20/00
2020/0018740 A1 * 1/2020 Hou ..... G06Q 10/04
2023/0266241 A1 * 8/2023 Ratcliffe ..... G01N 21/274 250/269.1

FOREIGN PATENT DOCUMENTS

CN 107605465 A 1/2018
CN 111027882 A 4/2020
CN 112394392 A 2/2021
CN 113064217 A 7/2021
(Continued)

OTHER PUBLICATIONS

Q. Wang et al., Seismic Prediction for Mesozoic-Cenozoic Source Rock Distribution in the Linhe Depression, Hetao Basin, Geoscience, Jun. 2021, vol. 35, No. 3, 850-860 (33 pages).
(Continued)

*Primary Examiner* — Mohamed Charioui
(74) *Attorney, Agent, or Firm* — Osha Bergman Watanabe & Burton LLP

(57) ABSTRACT

A method for predicting total organic carbon (TOC) and sensitive elements related to unsampled intervals of a well, is provided. The method includes obtaining first log data related to sampled intervals of a well, the first log data comprising a plurality of parameters corresponding to one or more of TOC data and sensitive elements data associated with the sampled intervals, generating a model representing a nonlinear relationship between the first log data and the TOC data and sensitive elements data using a machine learning engine, obtaining second log data related to unsampled intervals of the well, and determining predicted TOC and predicted sensitive elements associated with the unsampled intervals of the well using the model and the second log data.

20 Claims, 7 Drawing Sheets

(56) References Cited

FOREIGN PATENT DOCUMENTS

| | | | |
|---|---|---|---|
| CN | 113777655 | A | 12/2021 |
| WO | 2021211149 | A1 | 10/2021 |

OTHER PUBLICATIONS

Z. Han et al., "Using seismic and log information to predict and evaluate hydrocarbon source rocks: An example from rich oil depressions in Bohai Bay", Petroleum Exploration and Development, vol. 34; No. 1; pp. 55-59, 2007 (16 pages).

C. Qiang et al., Preliminary Prediction and Evaluation on Source Rock in Low Exploration Basin—A Case Study from the Northeast depression, South Yellow Sea basin, East China. J. Earth Sci., Oct. 2009, vol. 20, No. 5, pp. 836-847 (12 pages).

M. A. Keller et al., "Petroleum Source Rock Evaluation Based on Sonic and Resistivity Logs", in The Oil and Gas Resource Potential of the 1002 Area, Arctic National Wildlife Refuge, Alaska, by ANWR Assessment Team, U.S. Geological Survey Open-File Report 98-34, 1999 (62 pages).

M. R. Shalaby et al., "Integrated TOC prediction and source rock characterization using machine learning, well logs and geochemical analysis: Case study from the Jurassic source rocks in Shams Field, NW Desert, Egypt", Journal of Petroleum Science and Engineering, 2019, vol. 176, pp. 369-380 (12 pages).

Mulashani, A.K. et al., "Group Method of Data Handling (GMDH) Neural Network for Estimating Total Organic Carbon (TOC) and Hydrocarbon Potential Distribution (S1S2) Using Well Logs," Natural Resources Research, vol. 30, No. 5, pp. 3605-3622, Oct. 2021 (18 pages).

Shi, X. et al., "Application of extreme learning machine and neural networks in total organic carbon content prediction in organic shale with wire line logs," Journal of Natural Gas Science and Engineering, vol. 33, pp. 687-702, May 24, 2016 (16 pages).

Mahmoud, A.A.A. et al., "Determination of the total organic carbon (TOC) based on conventional well logs using artificial neural network," International Journal of Coal Geology, vol. 179, pp. 72-80, Jun. 1, 2017 (9 pages).

Chan, S. A. et al., "Total organic carbon (TOC) quantification using artificial neural networks: Improved prediction by leveraging XRF data," Journal of Petroleum Science and Engineering, vol. 208, pp. 0920-4105, Jul. 29, 2021 (15 pages).

AlMatouq, H. et. al., "SPE-198555-MS: An Artificial Intelligence Approach to Predict Molar Compositions of Reservoir Fluid Components," Society of Petroleum Engineers, pp. 1-7, Oct. 21-Oct. 22, 2019 (7 pages).

International Search Report issued in corresponding International Application No. PCT/US2024/015836; mailed Jun. 6, 2024 (7 pages).

Written Opinion of the International Searching Authority issued in corresponding International Application No. PCT/US2024/015836; dated Jun. 6, 2024 (8 pages).

* cited by examiner

SYSTEM AND METHOD FOR PREDICTING WELL CHARACTERISTICS

FIELD OF THE INVENTION

The present disclosure relates to systems and methods for predicting hydrocarbon well characteristics. Particularly, the disclosure relates to predicting Total Organic Carbon (TOC) and/or sensitive elements for unsampled well intervals using machine learning for the purpose of confirming the source rock richness and estimating the net thickness.

BACKGROUND

Petroleum source rock may be any rock with the sufficient organic matter content to generate and release enough hydrocarbons to form a commercial accumulation of oil or gas. Source rocks commonly include shales and limestones/mudstones. It is important to determine the amount of hydrocarbon generated by the source rock for at least the reason that evaluation of petroleum source rocks and hydrocarbon generation is an important process in petroleum exploration. However, calculation of a net source rock thickness based on the available data, such as wireline logs, is frequently a challenge during petroleum exploration operations.

Wireline broadly defines industry-specific methods, processes, and technologies related to cables and wires lowered into a wellbore during well drilling and production. Wireline applications that measure the properties and characteristics of wells based on sensors provided on the cables and wires are referred to as well logging or more commonly, wireline logging. With the advances and technological developments in logging tools, wirelines can measure a wide range of properties within the borehole of a well, for example, acoustic, electromagnetic, radioactive, spectrometry, and many others, allowing engineers to evaluate certain aspects of formations and their potential for further exploration. The raw data recorded as a series of measurements covering a depth range is typically referred to as a well log or a wireline log.

In traditional workflows implemented for determining net source rock thickness, underestimation of the net source rock thickness is commonly based on limitations in some of the available wireline log information (e.g., only well intervals having pyrolysis and/or mass spectrometry data available). This can lead to net thickness of unsampled intervals being based on cut offs from wireline estimations of sampled intervals, which can further be biased as a result, thus resulting in misleading information.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present inventors have determined that improvements in the processes for estimating net source rock thickness for unsampled well intervals may be desirable.

In one aspect, embodiments disclosed herein relate to a method for predicting total organic carbon (TOC) and sensitive elements related to unsampled intervals of a well. The method includes, obtaining first log data related to sampled intervals of a well, the first log data comprising a plurality of parameters corresponding to one or more of TOC data and sensitive elements data associated with the sampled intervals, generating a model representing a nonlinear relationship between the first log data and the TOC data and sensitive elements data using a machine learning engine, obtaining second log data related to unsampled intervals of the well, and determining predicted TOC and predicted sensitive elements associated with the unsampled intervals of the well using the model and the second log data.

The machine learning engine may include an artificial neural network (ANN) comprising one or more hidden layers and a summation layer, and the first log data may be integrated with the TOC data and divided into a TOC calibration subset and a TOC validation subset. The first log data may be integrated with sensitive elements data and divided into a sensitive elements calibration subset and a sensitive elements validation subset, and the operations may further include training and optimizing the ANN using the TOC calibration subset, the TOC validation subset, the sensitive elements calibration subset, and the sensitive elements validation subset.

A sigmoid function or Gaussian function may be used as an activation function in the one or more hidden layers and a linear function is used in the summation layer.

A quality check may be performed on the TOC data, and may include filtering the TOC data to remove values from contaminated samples by applying one or more of a hydrogen index, a production index, and an oxygen index as a filter to produce filtered TOC data, and confirming based on the sensitive elements data, a true source rock potential of the filtered TOC data.

The generating may include an optimization process, including determining an error value corresponding to a difference between a predicted TOC value and an actual TOC value or between a predicted sensitive element value and an actual sensitive element value, and in response to determining that the error value falls outside a pre-determined threshold, adjusting one or more learning parameters of the machine learning engine to reduce the error value.

The one or more learning parameters may include at least one of learning rate, a number of neurons, an activation function, and at least one weight factor of the machine learning engine, and the model may be generated by multiplying each parameter of the plurality of parameters by a weight factor selected based on an outcome of a nonlinear mapping using the activation function.

The operations may include performing a second quality check, the second quality check comprising confirming a source rock potential of the predicted TOC based on the predicted sensitive elements, and calculating a net source rock thickness from confirmed TOC data with respect to corresponding depth points.

The sensitive elements may be obtained from one or more of Pyrolysis Inductively Coupled Plasma-Mass Spectrometry (ICP-MS), x-ray fluorescence (XRF), and inorganic data.

The Pyrolysis, ICP-MS, XRF, inorganic data, and the first log data may be collected from wells within the same geological setting.

The operations may include calculating a volume of hydrocarbon generated and expelled using the predicted TOC and the predicted sensitive elements.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
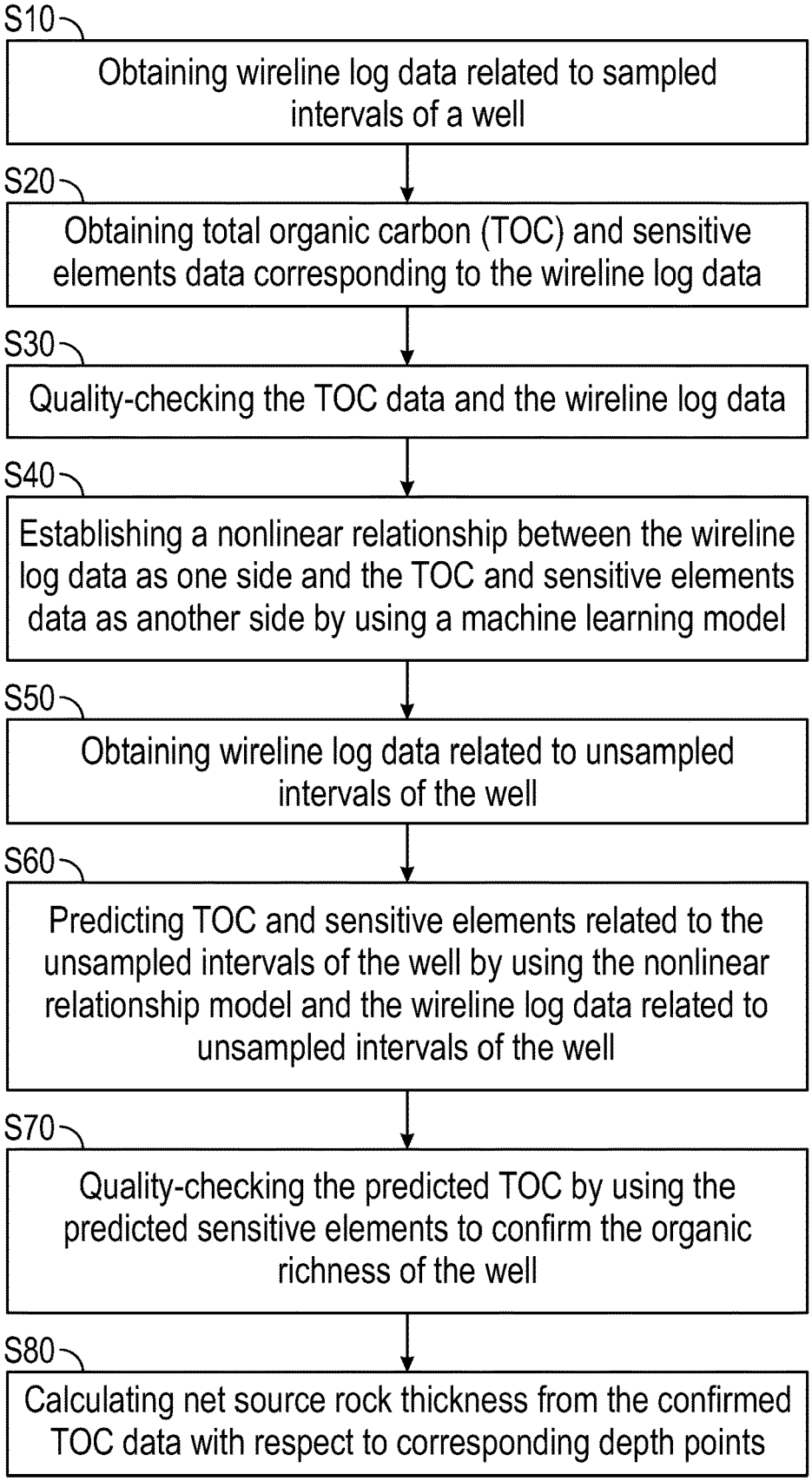
FIG. 1 shows a flowchart of a method for predicting well characteristics in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-6, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "a well" includes reference to one or more of such well.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowcharts may be omitted, repeated, and/or performed in a different order than the order shown. Accordingly, the scope disclosed herein should not be considered limited to the specific arrangement of steps shown in the flowcharts.

The subject matter of the dependent claims of one or more embodiments may be combined with other dependent claims except where otherwise contradictory.

Embodiments disclosed herein provide a new methodology that predicts TOC (Total Organic Carbon) data and sensitive elements of unsampled intervals of a well. Using the predicted TOC data and sensitive elements may aid in producing more accurate source rock richness and net thickness predictions, which in turn leads to a more accurate source rock characterization process.

FIG. 1 shows a flowchart illustrating a method for predicting well characteristics in accordance with one or more embodiments. This method can be implemented and performed by a system which includes a processor and a non-transitory computer readable medium, such as the device described in greater detail below with reference to FIG. 6. The non-transitory computer readable medium can store instructions that when executed by the processor cause the processor to perform the method.

As shown in FIG. 1, wireline log data related to sampled intervals of a well corresponding to first log data is obtained by the system (step S10). For example, a wireline log may be generated by continuously collecting and recording data from one or more sensors of a wireline inserted into a borehole during a drilling process. The recorded wireline log data can be provided to the system from an external source using, for example, a touch panel, a screen, and a mouse (e.g., for providing one or more files to be uploaded), or according to some embodiments, an internet linking module for downloading from a network (e.g., the Internet.) For example, sonic wireline log data including lithology values may be captured and saved to a storage medium accessible via the system as a wireline log, while neutron wireline log data including calibrated or uncalibrated porosity data as core porosity values may be captured and stored as another wireline log. A user may then provide each of the stored wireline logs to the system via an interface (not shown) presented by the system (e.g., an upload interface). The described techniques for obtaining wireline log data are intended as illustrative only, and the wireline logs data can be obtained using any method known by one of ordinary skill in the art.

The wireline log data comprises a plurality of parameters corresponding to one or more characteristics of a well, for example, total organic carbon (TOC) data and sensitive elements data associated with the sampled well intervals. The term "sampled well intervals" or "sampled intervals of a well" refers to well intervals from which samples, such as, for example, conventional core chips/plugs, side wall cores ditch cuttings, have been taken and/or whose petrophysical properties has been obtained using a variety of sensors or logging tools.

Availability of input data may determine the robustness of models according to embodiments of the invention. Certain wireline logs, corresponding to input data, and including, for example, Gamma Ray (GR), Sonic (DT), Deep Resistivity (RDEEP), Density (RHOB), Neutron Porosity (NPHI) are readily available for most well intervals.

Once the wireline logs have been obtained, TOC data and sensitive elements data corresponding to the wireline log data are obtained (step S20). For example, quantifying total organic carbon (TOC) from wireline logs may be performed via one or more of 1) a ΔlogR technique; 2) regression of core TOC with core bulk density; and 3) using an artificial neural network. The ΔlogR technique is one of the more common methods, and a ΔlogR can be calculated, for example, using three porosity wireline logs: density, neutron and sonic, based on the separation between the deep resistivity curve and the porosity logs. The ΔlogR can be converted into TOC, for example, through the level of organic maturity parameter (LOM), where the LOM has been previously determined via testing of samples. Core TOC and calculated ΔlogR may assist in calibration for estimating the LOM.

In addition, TOC can also be obtained from Rock Eval Pyrolysis. This can be done, for example, using the Delsi-Nermag Rock Eval II Plus TOC module. Samples chosen to be measured on the Rock Eval are usually subsampled from the freeze-dried material previously crushed for analyses on the coulometer. This method may include heating the sample in an inert atmosphere (such as helium) to determine the free hydrocarbons and hydrocarbon- and oxygen-containing compounds (such as $CO_2$) that are volatilized during the cracking of the kerogen. At 300° C., the free hydrocarbons are volatilized and measured as an S1 peak. At 550° C., the hydrocarbons released are recorded as a value S2. The temperature at which the value S2 reaches its maximum is recorded as Tmax. When the $CO_2$ is released, it can be recorded as a value S3.

The sensitive elements data may be obtained, for example, from Inductively Coupled Plasma-Mass Spectrometry (ICP-MS), X-Ray Fluorescence (XRF), inorganic data of the samples, etc. For example, XRF and ICP-MS are used to study metals in rock samples. ICP-MS may be used to perform microwave digestion on a sample to obtain the ICP-MS data. One illustrative machine for performing ICP-MS is the PE SCIEX ELAN 6000 ICP-MS system. To obtain XRF data, a rock sample may be pressed using a hydraulic pressing machine, and x-ray data obtained. One illustrative machine for XRF processing is the BRUKER S8 TIGER.

According to some embodiments of the invention, Pyrolysis, ICP-MS/XRF, and wireline log data may be collected from wells within the same geological setting. For example, a field may comprise a plurality of wells (e.g., 10 wells) with certain wells being in relative proximity to another (e.g., within a radius of 200-300 meters). Immediately proximate wells (e.g., those within the specified radius) of another well may be considered within the same geological setting.

According to some embodiments, the TOC data and the wireline logs data may be quality-checked (step S30). In one example, this quality checking of TOC data is a two-level quality checking on the TOC data. The first-level quality checking of TOC is done using hydrogen index (HI), production index (PI), and/or oxygen index (OI) as filters to remove values from samples to produce filtered TOC data. The second-level quality-checking of TOC is done using the sensitive elements to confirm the true source rock potential of the filtered TOC data.

For example, the TOC data may be quality checked by filtering the TOC data to remove values from contaminated samples by applying one or more of a hydrogen index, a production index, and an oxygen index as a filter to produce filtered TOC data. The values believed to have been contaminated (e.g., oil base mud, additives, etc.) or migrated HC or indigenous samples may not be reliable and are removed. For example, the following values that:

1) are less than 0.5% by weight of the potential source rock;
2) correspond to cases where S2 as determined above is less than 1;
3) correspond to cases where PI (production index) is greater than, for example, 0.44;
4) correspond to cases where a normalized value for S1 is greater than 100, as this may correspond to contaminated/migrated HC/indigenous material;
5) correspond to cases where a normalized index for S1 is greater than 1, which similarly may be considered as contaminated/migrated HC/indigenous.

The PI noted at 3) can be calculated from the values S1 and S2, as determined above, using the following equations:

$$HI = \frac{S2}{TOC} * 100$$

$$OI = \frac{S3}{TOC} * 100$$

$$PI = \frac{S1}{S1 * S2}$$

Because TOC data is affected by contamination, using such contaminated data may lead to false flags, and incorrect source rock evaluation results. The quality-checking step may further reduce or even eliminate such false flag issues. For example, considering Table 1 below, TOC values such as 1.32, 1.5, and 5.96 may, without using PI, hydrogen index (HI), and oxygen index (OI), be qualified as valid TOC values. However, by applying filters based on PI, OI, HI, etc., these values are determined as invalid, false flags, and removed by the quality check. By implementing these filters, increased data accuracy can be achieved.

TABLE 1

| TOC | S1 | S2 | S3 | TMAX | HI | OI | S1 + S2 | PI | Norm. S1 | S1_Index |
|---|---|---|---|---|---|---|---|---|---|---|
| 6.21 | 2.45 | 4.6 | 0.49 | 478.2 | 74 | 8 | 7.05 | 0.35 | 39.45 | 0.39 |
| 1.32 | 0.53 | 0.42 | 0.18 | 478.1 | 32 | 14 | 0.95 | 0.56 | 40.15 | 0.40 |
| 2.62 | 1.37 | 1.73 | 0.23 | 481.8 | 66 | 9 | 3.1 | 0.44 | 52.29 | 0.52 |
| 1.5 | 0.68 | 0.63 | 0.13 | 476.2 | 42 | 9 | 1.31 | 0.52 | 45.33 | 0.45 |
| 3.34 | 1.68 | 3.31 | 0.24 | 457.1 | 99 | 7 | 4.99 | 0.34 | 50.30 | 0.50 |
| 0.31 | 0.1 | 0.11 | 0.12 | 461.3 | 35 | 39 | 0.21 | 0.48 | 32.26 | 0.32 |
| 9 | 2.6 | 5.78 | 0.43 | 479.5 | 64 | 5 | 8.38 | 0.31 | 28.89 | 0.29 |

TABLE 1-continued

| TOC | S1 | S2 | S3 | TMAX | HI | OI | S1 + S2 | PI | Norm. S1 | S1_Index |
|---|---|---|---|---|---|---|---|---|---|---|
| 0.14 | 0.08 | 0.12 | 0.17 | 461 | 86 | 121 | 0.2 | 0.40 | 57.14 | 0.57 |
| 4.08 | 1.83 | 2.42 | 0.34 | 476.8 | 59 | 8 | 4.25 | 0.43 | 44.85 | 0.45 |
| 0.67 | 0.37 | 0.44 | 0.23 | 479.1 | 66 | 34 | 0.81 | 0.46 | 55.22 | 0.55 |
| 0.37 | 0.04 | 0.04 | 0.23 | 459.6 | 11 | 62 | 0.08 | 0.50 | 10.81 | 0.11 |
| 5.96 | 9.36 | 10.44 | 0.99 | 459.3 | 175.17 | 16.61 | 19.80 | 0.47 | 157.05 | 1.57 |

Then in a second-level quality check for TOC data, the sensitive elements data can be used. According to one example, TOC values exceeding a first threshold value of Molybdenum (Mo), Nickel (Ni), Strontium (Sr), Zinc (Zn), Tantilum (Ta), Uranium (U), Vanadium (V), Sulphur (S), and Zirconium (Zr) as well as values falling below a second threshold value of Manganese (Mn), Aluminum (Al), and Titanium (Ti) can be maintained in the dataset. Values falling outside of these thresholds can then be removed. The first and second threshold values may be determine as a function of acquired data related to TOC information previously acquired.

Figure 2:
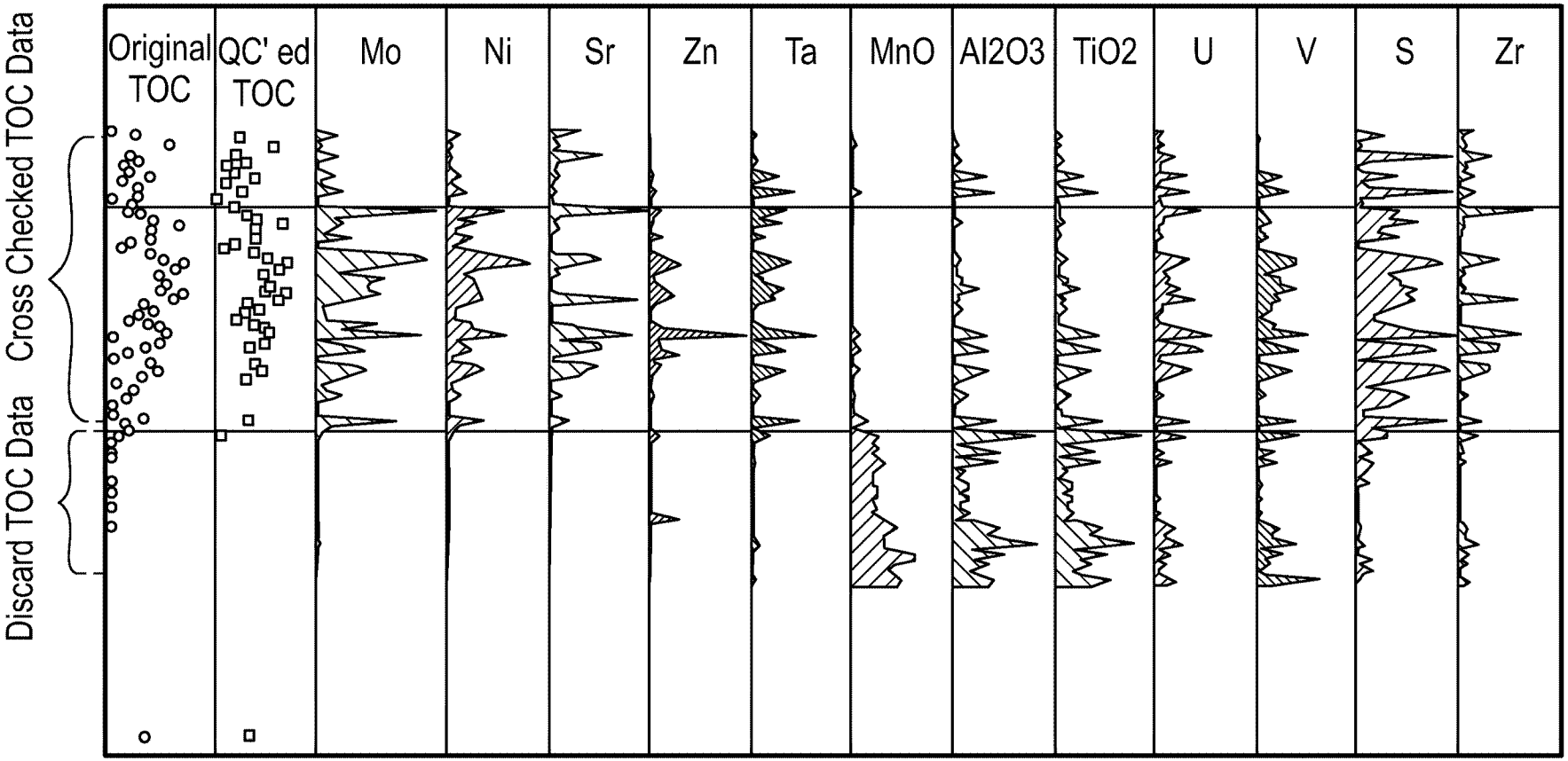
FIG. 2 shows a schematic diagram of the effect of quality checking of TOC.

FIG. 2 shows a schematic diagram of the effect of quality checking of TOC. From FIG. 2, it can be seen that some TOC values have been removed using sensitive elements data.

As to the quality checking of wireline logs data, according to some embodiments, it is done by removing erroneous values related to poor tool calibration and bad hole conditions. For tool or sensor failure and tools improper calibration, flag values such as "−999" or "−999.25" may be found in the wireline data, and are automatically removed. In another example, bad hole conditions can be detected using a caliper log, which tracks a hole diameter. Where the hole diameter is expected to be the standard 8.875 inches (where 1 inch=2.54 cm), any wireline log value corresponding to caliper log values exceeding +/−10% can be discarded to effect the filtering.

In step S40, a nonlinear relationship model representing the nonlinear relationship between the wireline logs data and the TOC and sensitive elements data, which correspond to the wireline log data related to sampled intervals of the well, is generated using a machine learning engine. According to some embodiments, there may be two types of nonlinear relationships included in the nonlinear relationship model. For example, TOC and the sensitive elements are derived from different measurements taken from different properties of a rock sample. Hence, different relationships are established between these components. Further, each sensitive element may have a different nonlinear relationship for at least the reason that each element is different in nature, properties, and/or quantities.

Figure 3:
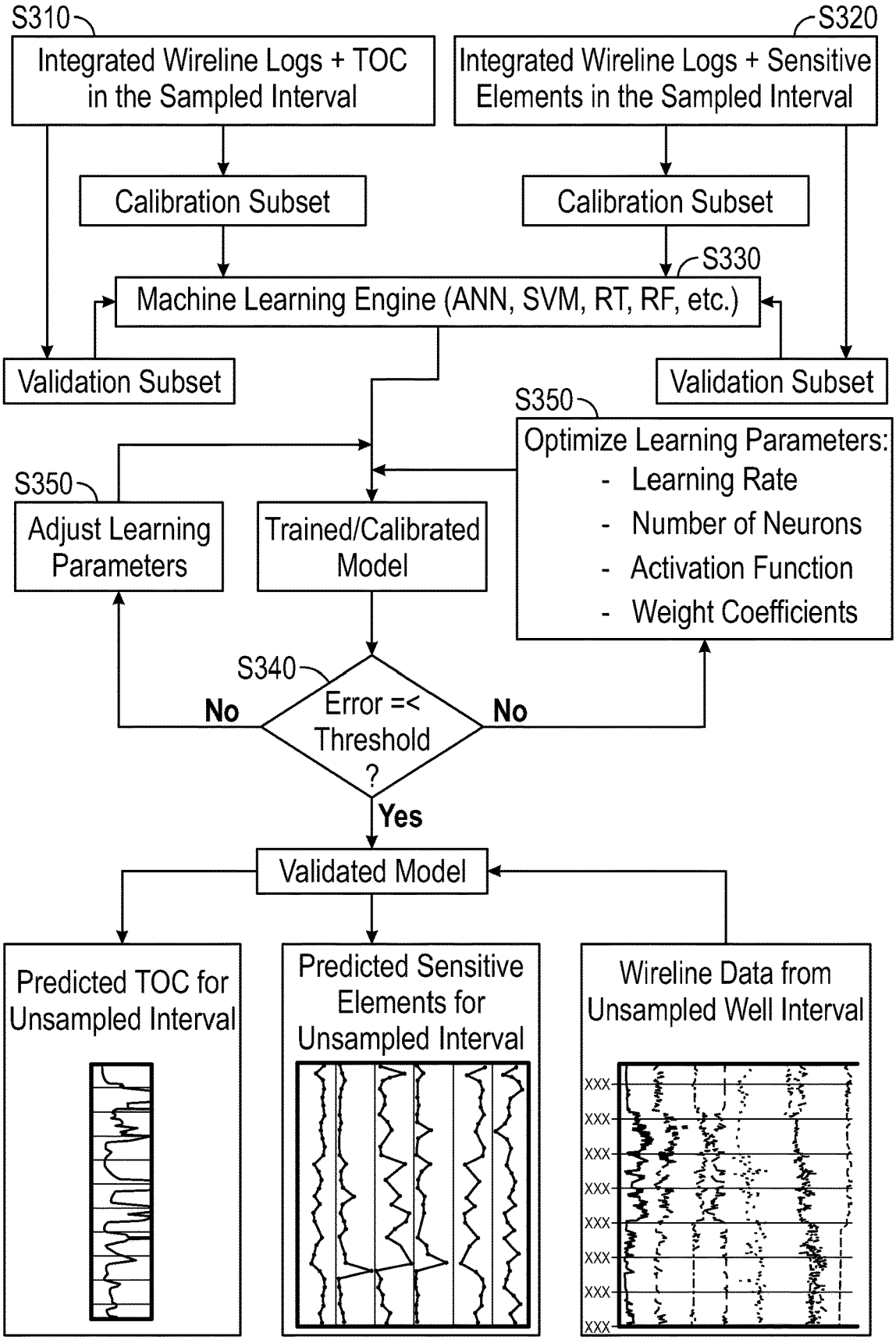
FIG. 3 shows a flowchart highlighting a method for generating, training, and applying a machine learning model in accordance with one or more embodiments.

FIG. 3 shows a flowchart highlighting a method for generating, training, and applying a machine learning model in accordance with one or more embodiments. As seen from FIG. 3, the wireline log data and TOC data related to sampled intervals of a well may be integrated and divided into a (TOC) calibration subset and a (TOC) validation subset (step S310). The wireline-TOC data integration is done by resampling. The wireline data has regular sampling rate while the TOC is irregular (point data). So, the TOC data is resampled by interpolation methods at the rate of the wireline. At the end, the wireline data is integrated with each TOC value corresponding to exactly the same depth point in the wireline. The integrated data are then divided into the (TOC) calibration subset and the (TOC) validation subset, randomly or according to a predetermined ratio. This predetermined ratio can be, for example, 70% calibration subset with 30% for the validation subset. The calibration subset (training set) is used to train (or teach) the model with all the hidden and apparent patterns. This is the reason it has to be much more than the validation subset. The validation subset is used to test the performance of the trained model on a data outside the training set. The result of the validation determines next steps: when the result is acceptable, the model can be used to make new predictions. Otherwise, either or both of the model and data should be revisited for possible improvement in the model performance.

Similarly, the wireline log data and sensitive elements related to the sampled well intervals may be integrated and divided into a (sensitive elements) calibration subset and a (sensitive elements) validation subset (step S320). This may be performed in a similar manner to that described with respect to step S310, for example. The calibration subsets (training sets) and validation subsets are then used to train the machine learning engine to generate a nonlinear relationship model representing the nonlinear relationship between the wireline log data and the TOC and sensitive elements data (step S330).

The machine learning engine or machine learning model may comprise one or more of an artificial neural network (ANN), a support vector machine, a decision tree, a regression tree (RT), a random forest, an extreme learning machine (ELM), Type I and Type II Fuzzy Logic (T1FL/T2FL), a multivariate linear regression, etc.

Machine learning model types are usually associated with additional "hyperparameters" which further describe the model. For example, hyperparameters providing further detail about a neural network may include, but are not limited to, the number of layers in the neural network, choice of activation functions, inclusion of batch normalization layers, and regularization strength. The selection of hyperparameters surrounding a model is referred to as selecting the model "architecture". Generally, multiple model types and associated hyperparameters are tested and the model type and hyperparameters that yield the greatest predictive performance on a hold-out set of data is selected.

Figure 4:
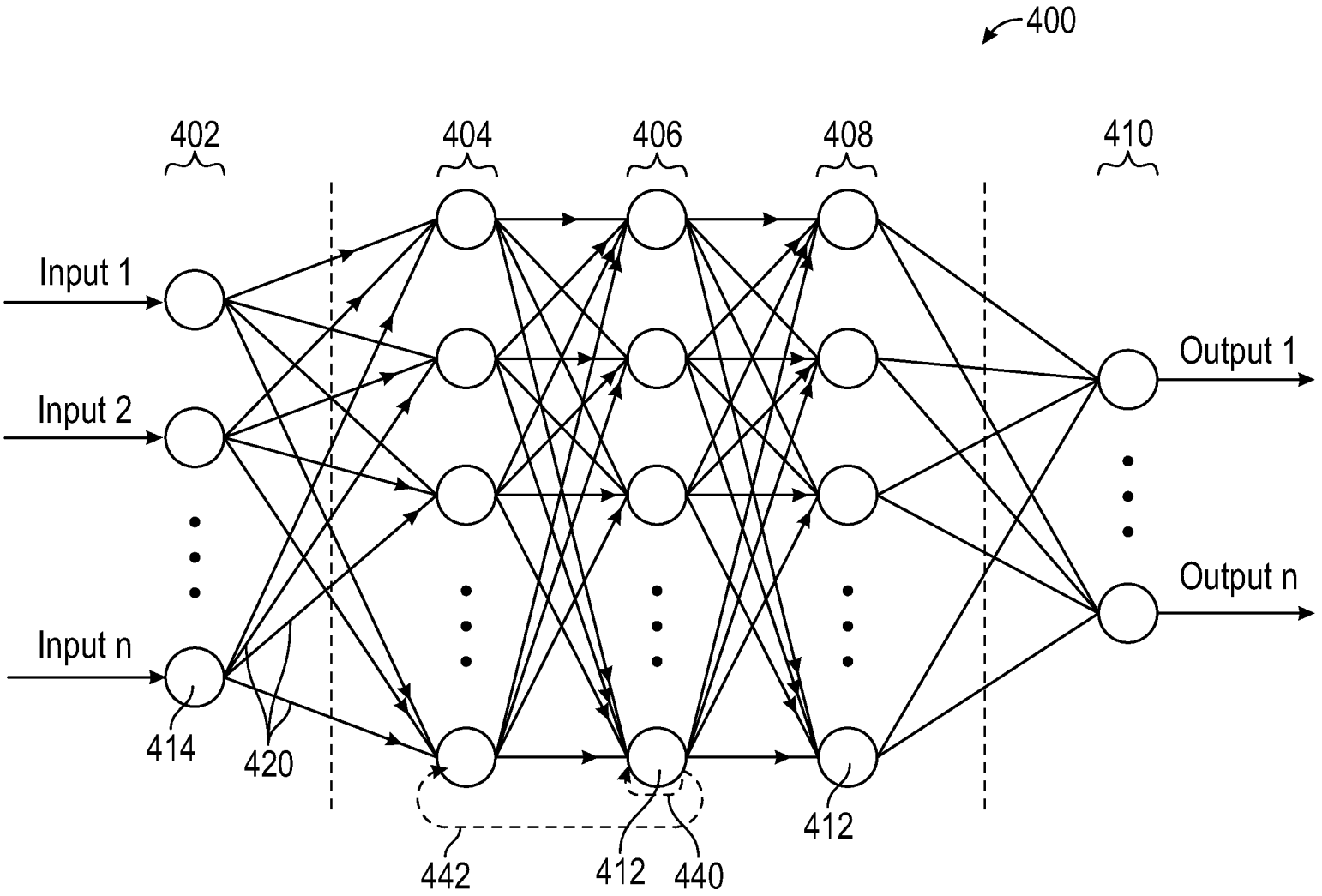
FIG. 4 shows a schematic diagram of an illustrative artificial neural network (ANN) in accordance with one or more embodiments.

FIG. 4 shows an illustrative architecture for a neural network configured for TOC and sensitive elements predictions according to embodiments of the present disclosure. A neural network 400 uses a series of mathematical functions to make predictions based on observations. A neural network 400 may include an input layer 402, hidden layers, such as a first hidden layer 404, a second hidden layer 406, a summation layer 408, and an output layer 410. There can be more or fewer hidden layers, and the number described herein is intended as illustrative only. The number of the hidden layers may depend on, for example, the volume and complexity of the training data set, among other things. The parameters of a machine learning model are be tuned to match the complexity or otherwise of the training data to ensure optimal model performance. For example, the number of neurons in the hidden layer has to be carefully chosen so as to avoid underfitting and overfitting of the model.

Underfitting is when a model is too weak to establish the relationship intended in the training data. The number of hidden neurons can be increased or the quantity of data reduced. Overfitting occurs when the model is too complex for the data. Either the number of hidden neurons is reduced or more data is added to the training set. One way to achieve this is to automate the training process by using a Bayesian optimization technique that will try different values of the tuning parameters to evolve their optimal values for optimal model performance. Each of these layers may represent a vector where each element within each vector is represented by an artificial neuron, such as artificial neurons 412 (also referred to herein as a "neuron").

The input layer 402 may receive an observed data vector x where each neuron, such as neuron 414, within the input layer 402 receives one element $x_i$ within x. Each element is a value that represents examples of the input wireline logs data. The vector x may be called "input data". FIG. 4 displays the input data or vector x as elements $x_1$, $x_2$, $x_i \ldots x_n$, where $x_1$ may be a value that represents a wireline log sample at a first depth, and $x_2$ may represents a wireline log sample at a second depth, etc.

The output layer 410 may represent the vector y where each neuron, such as neuron 416, within the output layer 410 represents each element $y_j$ within y. The vector y may be called "output data." FIG. 4 displays the output data or vector y with m elements, where an element $y_j$ may be a value that represents a target variable (TOC or sensitive elements).

Neurons in the input layer 402 may be connected to neurons in the first hidden layer 404 through connections, such as connections 420. A connection 420 may be analogous to a synapse of the human brain and may have a weight associated to it. The weights for all connections 420 between the input layer 402 and the first hidden layer 404 make up a first array of weights w, with elements $w_{ik}$:

$$w = \begin{bmatrix} w_{11} & w_{12} & w_{1k} & w_{1L} \\ w_{21} & w_{22} & w_{2k} & w_{2L} \\ w_{i1} & w_{i2} & w_{ik} & w_{iL} \\ w_{n1} & w_{n2} & w_{nk} & w_{nL} \end{bmatrix}, \quad \text{Equation (1)}$$

where k indicates a neuron in the hidden first hidden layer and L is the total number of neurons in the first hidden layer for the embodiment shown in FIG. 4. The elements in each column are the weights associated with the connections 420 between each of the n elements in vector x that propagate to the same neuron k 412 in the first hidden layer 404. This element or weight factor, $w_{ik}$, typically ranging from 0 to ±1, may be obtained, for example, based on a correspondence with a degree of nonlinearity in the map linking the wireline log data and the TOC and sensitive elements. The degree of nonlinearity depends on the complexity of the relationship between the input features (wireline logs in this case) and the target property (TOC and sensitive elements in this case). The complexity and nonlinearity are handled by the mix of weightings, activation functions (sigmoid, gaussian, etc.), learning functions (gradient descent, Levenberg-Marquardt, Quasi-Newton, feedforward Backpropagation, Conjugate Gradient, etc.). The weights are determined through an iterative process. Initial weights are set randomly. After the computations, the summation layer compares the result of the model with the actual. If the error is not within a tolerance level, the network is propagated backwards to the hidden layer and weights are adjusted by multiplying with a certain factor. The process goes forward and backwards until the error tolerance is attained (convergence) or the maximum number of iterations is reached.

The value of a neuron k, $a_k$, in the first hidden layer may be computed as $$a_k = g_k\left(b_k + \sum_i x_i w_{ik}\right), \quad \text{Equation (2)}$$

where, in addition to the elements of the input vector x and the first array of weights w, elements from a vector b, which has a length of L, and an activation function $g_k$ are referenced. The vector b represents a bias vector and its elements may be referred to as biases. In some implementations, the biases may be incorporated into the first array of weights such that Equation (2) may be written as $a_k = g_k(\Sigma_i x_i w_{ik})$.

Each weight $w_{ik}$ within the first array of weights may amplify or reduce the significance of each element within vector x. The weighting process may be used to determine the effect a wireline log has on the nonlinear relationship model.

Some activation functions may include the linear function g(x)=x, Gaussian function $g(x)=e^{-x^2}$, sigmoid function $$g(x) = \frac{1}{1 + e^{-x}},$$

and rectified linear unit function g(x)=max(0, x), however, any other suitable functions may be employed. Every neuron in a neural network may have a different associated activation function. Often, as a shorthand, activation functions are described by the function $g_k$ of which the function is composed. That is, an activation function composed of a linear function may simply be referred to as a linear activation function without undue ambiguity. The transformation is performed by plugging the value of each wireline log in to the equation of linear/gaussian/sigmoid functions. It is a way of taking the input values form their natural form into a different at a high-dimensional space. A simple example is the log-normalization where a number like "3000.52" and "20.53" are converted to "3.48" and "1.31" respectively.

Similarly, the weights for all connections 420 between the first hidden layer 404 and the second hidden layer 406 make up a second array of weights. The second array of weights will have L rows, one for each neuron in the first hidden layer 404, and a number of columns equal to the number of neurons in the second hidden layer 406. Likewise, a second bias vector and second activation functions may be defined to relate the first hidden layer 404 to the second hidden layer 404. The values of the neurons for the second hidden layer 406 are likewise determined using Equation (2) as before, but with the second array of weights, second bias vector, and second activation functions.

Similarly, values of the neurons for the summation layer 408 may be likewise determined using Equation (2) as before, but with a third array of weights, a third bias vector, and a third activation function, generated similarly to those described above. According to some embodiments of the disclosure, the third activation function may be a linear function.

This process of determining the values for a hidden layer based on the values of the neurons of the previous layer and associated array of weights, bias vector, and activation functions is repeated for all layers in the neural network. As stated above, the number of layers in a neural network may be configured as a hyperparameter of the neural network 400.

It is noted that FIG. 4 depicts a simplified and generalized neural network 400 for facilitating explanation of embodiments of the present disclosure. In some embodiments, the neural network 400 may contain specialized layers, such as a normalization layer, or additional connection procedures, like concatenation. One skilled in the art will appreciate that these alterations are all intended to fall within the scope of the present disclosure. For example, neural network 400 with only connections 420 passing signals forward from the input layer 402 to the first hidden layer 404, from the first hidden layer 404 to the second hidden layer 406 and so forth constitutes a feed-forward neural network. However, in some embodiments a neural network may have any number of connections, such as connection 440, that passes the output of a neuron 414 backward to the input of the same neuron 412, and/or any number of connections 442 that passes the output of the neuron 412 in a hidden layer, such as hidden layer 406 backward to the input of a neuron in a preceding hidden layer, such as hidden layer 404. A neural network with backward-passing connections, such as connection 440 and 442 may be termed a recurrent neural network.

For a neural network 400 to complete a "task" of predicting an output from an input, the neural network 400 must first be trained. Training may be defined as the process of determining the values of all the weights and biases for each weight array and bias vector encompassed by the neural network 400.

To begin training of the neural network 400, the weights and biases may be assigned initial values in process of initialization. These values may be assigned randomly, according to a prescribed distribution, manually, or by other suitable assignment mechanism. Once the weights and biases have been initialized, the neural network 400 may act as a function, such that it may receive inputs and produce an output. As such, at least one input is propagated through the neural network 400 to produce an output.

Training of the model may be supervised or unsupervised. According to a supervised training plan, a training dataset (the validation subset and calibration subset) is composed of labeled inputs and associated target(s), where the target(s) represent the "ground truth", or the otherwise desired output. That is, the training dataset may be a plurality of input data and a plurality of output data either of which are observed or simulated. The neural network 400 output is compared to the associated input data target(s). The comparison of the neural network 400 output to the target(s) is typically performed by a so-called "loss function"; although other names for this comparison function such as "error function", "objective function", "misfit function", and "cost function" are commonly employed. Many types of loss functions are available, such as the mean-squared-error function, however, the general characteristic of a loss function is that the loss function provides a numerical evaluation of the similarity between the neural network 400 output and the associated target(s). The loss function may also be constructed to impose additional constraints on the values assumed by the weights and biases, for example, by adding a penalty term, which may be, for example, physics-based, or a regularization term. Generally, the goal of a training procedure is to alter the weights and biases to promote similarity between the neural network 400 output and associated target(s) over the training dataset. Thus, the loss function is used to guide changes made to the weights and biases, typically through a process called "backpropagation".

While a full review of the backpropagation process exceeds the scope of this disclosure, a brief summary is provided. Backpropagation consists of computing the gradient of the loss function over the weights and biases. The gradient indicates the direction of change in the weights and biases that results in the greatest change to the loss function. Because the gradient is local to the current weights and biases, the weights and biases are typically updated by a "step" in the direction indicated by the gradient. The step size is often referred to as the "learning rate" and need not remain fixed during the training process. Additionally, the step size and direction may be informed by previously seen weights and biases or previously computed gradients. Such methods for determining the step direction are usually referred to as "momentum" based methods.

Once the weights and biases have been updated, or altered from their initial values, through a backpropagation step, the neural network 400 may produce different outputs. Thus, the procedure of propagating at least one input through the neural network 400, comparing the neural network 400 output with the associated target(s) with a loss function, computing the gradient of the loss function with respect to the weights and biases, and updating the weights and biases with a step guided by the gradient, is repeated until a termination criterion is reached. Common termination criteria are: reaching a fixed number of updates, otherwise known as an iteration counter; a diminishing learning rate; noting no appreciable change in the loss function between iterations; reaching a specified performance metric as evaluated on the data or a separate hold-out dataset. The learning rate is a hyperparameter that controls how much to change the model in response to the estimated error each time the model weights are updated. Once the termination criterion is satisfied, and the weights and biases are no longer intended to be altered, the neural network 400 is said to be "trained".

Returning to FIG. 3, after step S330, the generated nonlinear relationship model may then be improved (e.g., optimized), for example, iteratively. The improvement/optimization process involves determining whether the error between the model prediction and the actual values of TOC and sensitive elements is kept within a predetermined threshold (step S340) and adjusting appropriate learning parameters (step S350), such as the learning rate, number of neurons, activation function, and weight coefficients, to their optimal values such that the error between the model prediction and the actual values of TOC and sensitive elements is kept within the predetermined threshold. For example, in one embodiment, the predetermined threshold might be 3% of the actual values. The error threshold may depend on the criticality of the problem being addressed. These adjustable learning parameters can also be called "tuning parameters" for the machine learning engine. The same calibration subset is used over and over while looking for the optimal parameters.

As seen from FIG. 3, the model prediction (the prediction result of the nonlinear relationship model) is compared with the actual calibration and validation data. If the error between the model prediction and the training and actual validation measurements is below the predetermined threshold (S340: yes), the model is considered at a desirable improvement level (e.g., optimized) and can receive the wireline logs from the unsampled well interval to predict the TOC and sensitive elements for the unsampled interval based solely on the wireline log data.

Otherwise (S340: no), re-adjustment of the learning parameters is performed again. This process of matching the model prediction with the actual training and validation data is called the feed-forward process. The process of re-adjusting the model parameters to increase the match and reduce the error between the model prediction and the actual validation measurements is another application of back-propagation. In this process, before the model converges, only the calibration subset is used. After the model converges, the validation set is brought in to check the goodness of the fit of the model, that is, how the model will perform on a data outside the calibration subset.

It should be noted that these feed-forward and backpropagation processes have the capability to remove the bias embedded in the original TOC and sensitive elements. This iteration continues until the error comes within a predetermined threshold or the maximum number of iterations is reached. The best model achieved up to that point is used for the prediction. One desirable outcome of training and validation is limiting or even avoidance of under- and over-fitting of the model.

Returning to FIG. 1, wireline log data related to unsampled intervals of the well (second log data) is obtained (S50). This can be done, for example, as described with respect to step S10, or in any other suitable manner.

In step S60, TOC and sensitive elements related to the unsampled intervals of the well are predicted by using the nonlinear relationship model and the wireline log data related to unsampled intervals of the well (also see FIG. 4). For example, based on the inputs from the unsampled well intervals provided to the trained machine learning model, the outputs of the trained machine learning model can be considered to correspond to the TOC and sensitive elements of those unsampled well intervals.

In step S70, the predicted TOC can be quality-checked by using the predicted sensitive elements to confirm the organic richness of the well. This can be done, for example, as described with respect to S30, or in any other suitable manner.

In step S80, net source rock thickness can be calculated from the confirmed TOC data with respect to corresponding depth points. After the predicted TOC is checked as described, the net thickness comprising a continuous section of, for example, 1.5 ft is calculated. This is the estimated net source rock thickness.

The described techniques may be integrated with other technology such as, for example, software for exploration data analysis (e.g., Techlog), for further analysis of the results. For example, the predicted TOC and the predicted sensitive elements could be used to determine the extent of source rock in the area to validate source rock gross depositional environment (GDE) maps.

Alternatively, or in addition, the predicted TOC and the predicted sensitive elements from the unsampled well intervals may be transferred or used to calculate a volume of hydrocarbon generated and expelled from the formation. The ultimate expellable Potential (UEP) represents the cumulative mass of oil and gas that can be expelled from a source rock upon complete maturation. It can be calculated using the following equation:

$$\text{Mass (kg)} = [\text{Area (m2)} * SR \text{ Net thickness (m)} * \text{Bulk Density} * TOC(\text{wt. \%}) * HI(mgHC/gTOC)]/0.0001$$

According to some embodiments, the non-linear model may undergo re-calibration as desired. For example, when new or additional data (wireline logs and their corresponding TOC and sensitive elements from newly analyzed rock samples) are available, such information may be added to the existing calibration database. With the updated calibration database, it may be desirable to updated a previous set of tuning parameters due to, for example, the model not fitting adequately to the newly updated data. To compensate, new tuning parameters may be derived through the optimization and feed forward/back-propagation cycle to establish a desired fit (e.g., below the predetermined error threshold) between the updated wireline log data and the new set of TOC and sensitive elements.

Figure 5A:
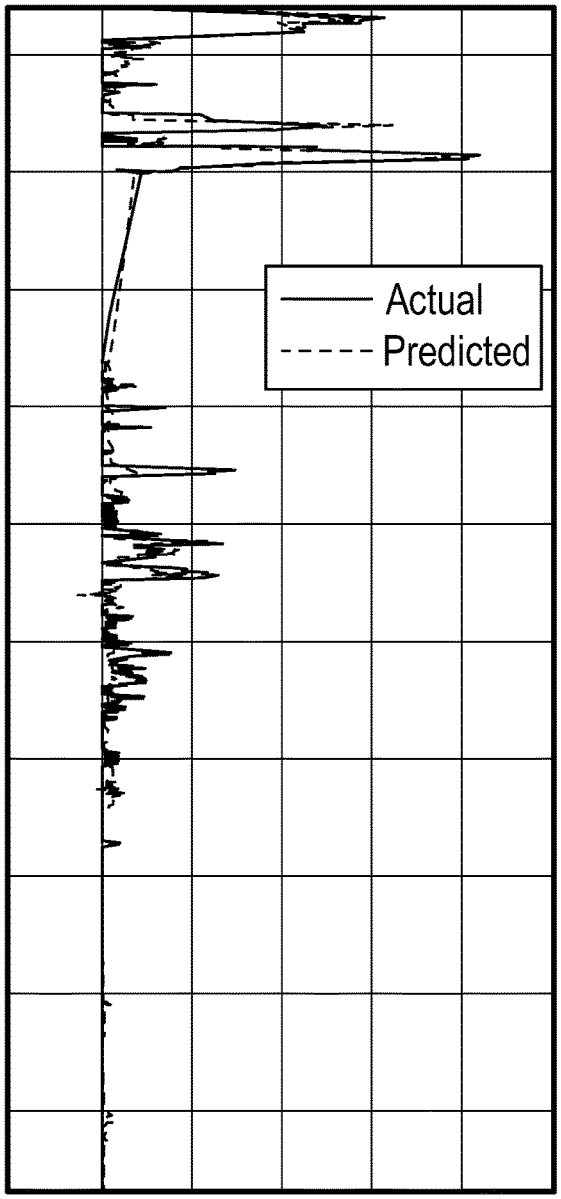
FIG. 5*a* shows an illustrative graph of results of a calibration plot for TOC prediction from wireline logs data.
Figure 5B:
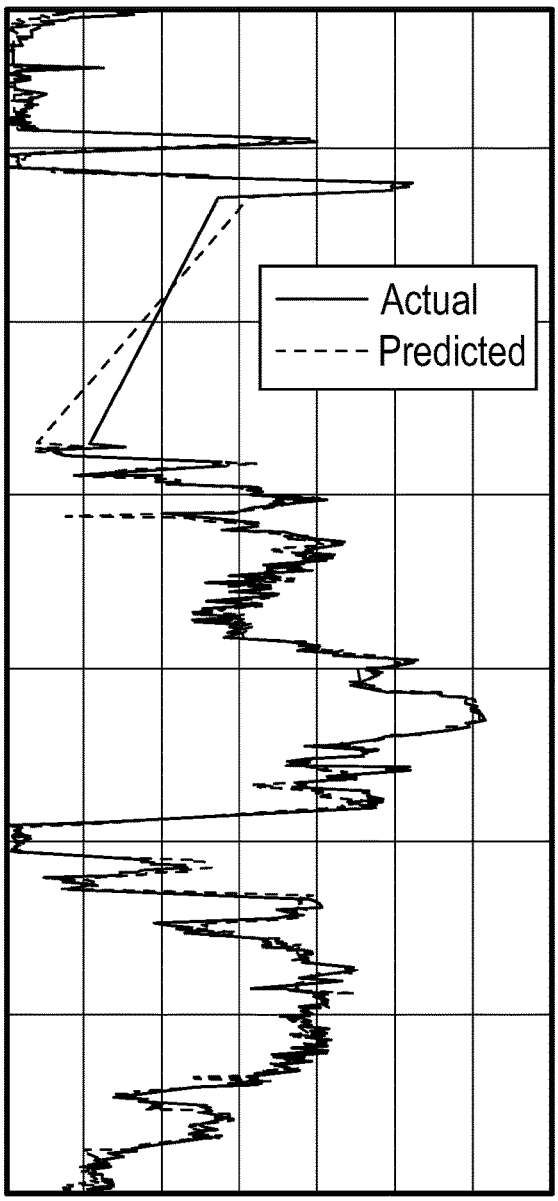
FIG. 5*b* shows illustrative graph of results of a prediction plot for TOC prediction from wireline logs data.
Figure 5C:
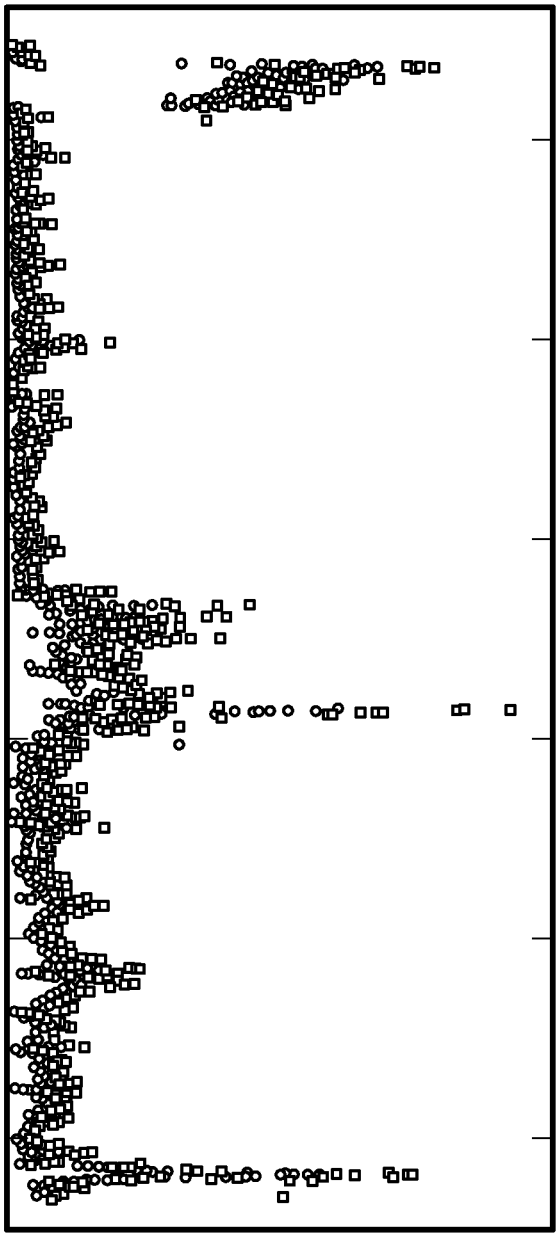
FIG. 5*c* shows schematically example results of calibration plot for sensitive element prediction from wireline logs data.
Figure 5D:
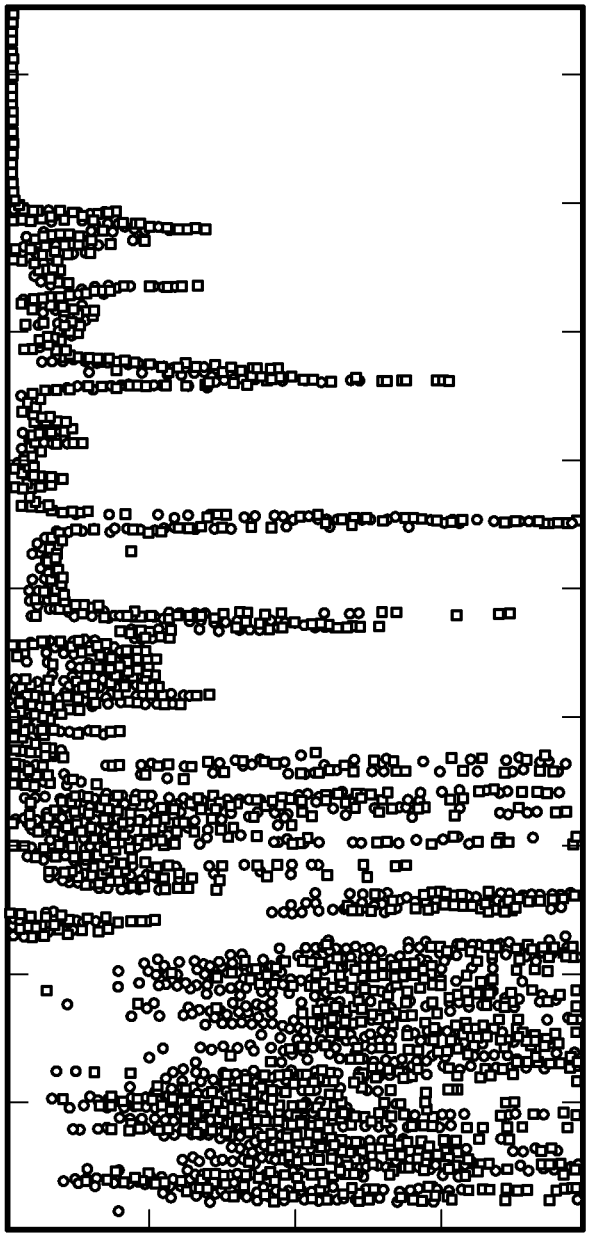
FIG. 5*d* shows schematically example results of prediction plot for sensitive element prediction from wireline logs data.

FIG. 5*a* shows schematically, example results of a calibration plot for TOC prediction from wireline logs data. FIG. 5*b* shows schematically, example results of a prediction plot for TOC prediction from wireline logs data. These plots are examples of expected output of such relationship between wireline logs and TOC for (5*a*) the calibration and (5*b*) the validation. FIGS. 5*c* and 5*d* shows schematically, example results of (a) a calibration plot and (b) a prediction plot for a sensitive element from wireline logs data. Similarly, the plots show an expected example output of the prediction of one element (such as Manganese (Mn) or Molybdenum (Mo)).

Figure 6:
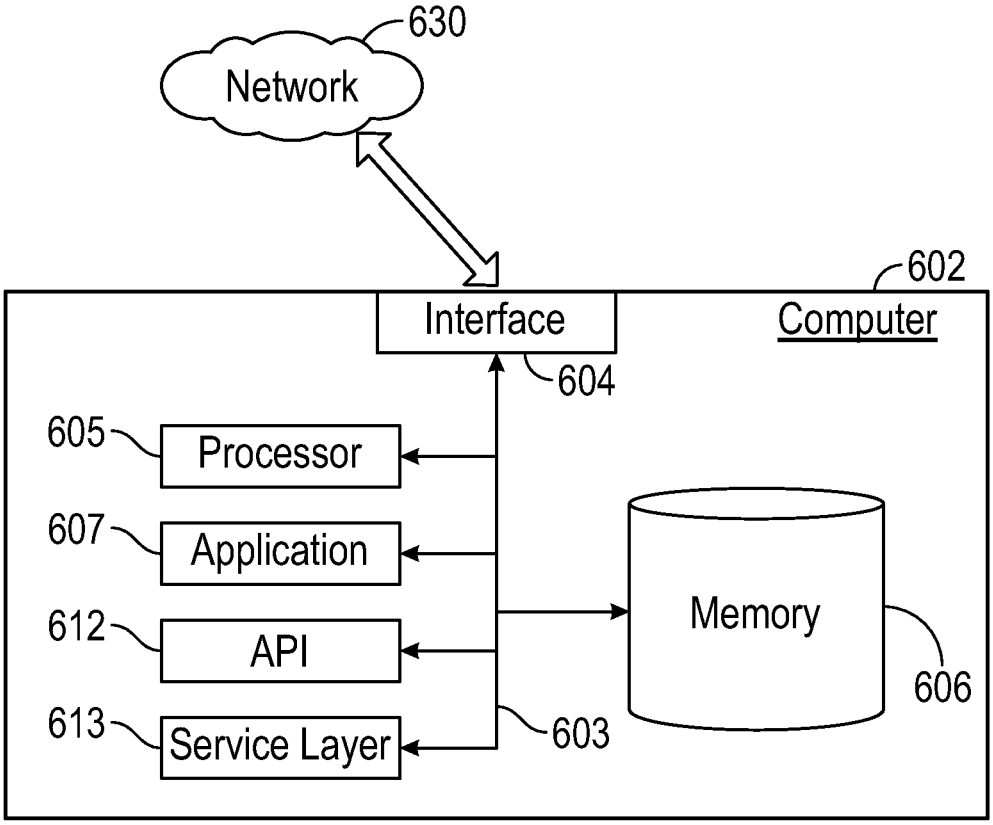
FIG. 6 shows a computer system in accordance with one or more embodiments.

FIG. 6 depicts a block diagram of a computer system 602 used to provide computational functionalities associated with described algorithms, methods, functions, processes, flows, and procedures as described in this disclosure, according to one or more embodiments. For example, the computer system 602, and the processor of the computer system, may be used to perform one or more steps of the flowchart (calculations, determinations, etc.) in FIGS. 1 and 3 and to implement the machine learning engine of FIG. 4.

The illustrated computer 602 is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 602 may include a computer that includes an input device, such as a keypad, keyboard, touch screen, or other device that can accept user information, and an output device that conveys information associated with the operation of the computer 602, including digital data, visual, or audio information (or a combination of information), or a GUI.

The computer 602 can serve in a role as a client, network component, a server, a database or other persistency, or any other component (or a combination of roles) of a computer system for performing the subject matter described in the instant disclosure. The illustrated computer 602 is communicably coupled with a network 630. In some implementations, one or more components of the computer 602 may be configured to operate within environments, including cloud-computing-based, local, global, or other environment (or a combination of environments).

At a high level, the computer 602 is an electronic computing device operable to receive, transmit, process, store, or manage data and information associated with the described subject matter. According to some implementations, the computer 602 may also include or be communicably coupled with an application server, e-mail server, web server, caching server, streaming data server, business intelligence (BI) server, or other server (or a combination of servers).

The computer 602 can receive requests over network 630 from a client application (for example, executing on another computer 602) and responding to the received requests by processing the said requests in an appropriate software application. In addition, requests may also be sent to the computer 602 from internal users (for example, from a command console or by other appropriate access method), external or third-parties, other automated applications, as well as any other appropriate entities, individuals, systems, or computers.

Each of the components of the computer 602 can communicate using a system bus 603. In some implementations, any or all of the components of the computer 602, both hardware or software (or a combination of hardware and software), may interface with each other or the interface 604 (or a combination of both) over the system bus 603 using an application programming interface (API) 612 or a service layer 613 (or a combination of the API 612 and service layer 613. The API 612 may include specifications for routines, data structures, and object classes. The API 612 may be either computer-language independent or dependent and refer to a complete interface, a single function, or even a set of APIs. The service layer 613 provides software services to the computer 602 or other components (whether or not illustrated) that are communicably coupled to the computer 602. The functionality of the computer 602 may be accessible for all service consumers using this service layer. Software services, such as those provided by the service layer 613, provide reusable, defined business functionalities through a defined interface. For example, the interface may be software written in JAVA, C++, or other suitable language providing data in extensible markup language (XML) format or another suitable format. While illustrated as an integrated component of the computer 602, alternative implementations may illustrate the API 612 or the service layer 613 as stand-alone components in relation to other components of the computer 602 or other components (whether or not illustrated) that are communicably coupled to the computer 602. Moreover, any or all parts of the API 612 or the service layer 613 may be implemented as child or sub-modules of another software module, enterprise application, or hardware module without departing from the scope of this disclosure.

The computer 602 includes an interface 604. Although illustrated as a single interface 604 in FIG. 6, two or more interfaces 604 may be used according to particular needs, desires, or particular implementations of the computer 602. The interface 604 is used by the computer 602 for communicating with other systems in a distributed environment that are connected to the network 630. Generally, the interface 604 includes logic encoded in software or hardware (or a combination of software and hardware) and operable to communicate with the network 630. More specifically, the interface 604 may include software supporting one or more communication protocols associated with communications such that the network 630 or interface's hardware is operable to communicate physical signals within and outside of the illustrated computer 602.

The computer 602 includes at least one computer processor 605. Although illustrated as a single computer processor 605 in FIG. 6, two or more processors may be used according to particular needs, desires, or particular implementations of the computer 602. Generally, the computer processor 605 executes instructions and manipulates data to perform the operations of the computer 602 and any machine learning networks, algorithms, methods, functions, processes, flows, and procedures as described in the instant disclosure.

The computer 602 also includes a memory 606 that holds data for the computer 602 or other components (or a combination of both) that can be connected to the network 630. For example, memory 606 can be a database storing data consistent with this disclosure. Although illustrated as a single memory 606 in FIG. 6, two or more memories may be used according to particular needs, desires, or particular implementations of the computer 602 and the described functionality. While memory 606 is illustrated as an integral component of the computer 602, in alternative implementations, memory 606 can be external to the computer 602.

The application 607 is an algorithmic software engine providing functionality according to particular needs, desires, or particular implementations of the computer 602, particularly with respect to functionality described in this disclosure. For example, application 607 can serve as one or more components, modules, applications, etc. Further, although illustrated as a single application 607, the application 607 may be implemented as multiple applications 607 on the computer 602. In addition, although illustrated as integral to the computer 602, in alternative implementations, the application 607 can be external to the computer 602.

There may be any number of computers 602 associated with, or external to, a computer system containing a computer 602, wherein each computer 602 communicates over network 630. Further, the term "client," "user," and other appropriate terminology may be used interchangeably as appropriate without departing from the scope of this disclosure. Moreover, this disclosure contemplates that many users may use one computer 602, or that one user may use multiple computers 602.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A method for predicting total organic carbon (TOC) and sensitive elements related to unsampled intervals of a well, the method comprising:

obtaining first log data related to sampled intervals of a well, the first log data comprising a plurality of parameters corresponding to one or more of TOC data and sensitive elements data associated with the sampled intervals;

generating a model representing a nonlinear relationship between the first log data and the TOC data and sensitive elements data using a machine learning engine;

obtaining second log data related to unsampled intervals of the well; and determining predicted TOC and predicted sensitive elements associated with the unsampled intervals of the well using the model and the second log data;

wherein the machine learning engine comprises an artificial neural network (ANN) comprising one or more hidden layers and a summation layer, and wherein the first log data is integrated with the TOC data and divided into a TOC calibration subset and a TOC validation subset, and wherein the first log data is integrated with sensitive elements data and divided into a sensitive elements calibration subset and a sensitive elements validation subset, and wherein the method further comprises training and optimizing the ANN using the TOC calibration subset, the TOC validation subset, the sensitive elements calibration subset, and the sensitive elements validation subset.

2. The method according to claim 1, wherein a sigmoid function or Gaussian function is used as an activation function in the one or more hidden layers and a linear function is used in the summation layer.

3. The method according to claim 1, wherein the generating comprises an optimization process, the optimization process comprising:

determining an error value corresponding to a difference between a predicted TOC value and an actual TOC value or between a predicted sensitive element value and an actual sensitive element value; and in response to determining that the error value falls outside a pre-determined threshold, adjusting one or more learning parameters of the machine learning engine to reduce the error value.

4. The method according to claim 3, wherein the one or more learning parameters comprises at least one of learning rate, a number of neurons, an activation function, and at least one weight factor of the machine learning engine, and wherein the model is generated by multiplying each parameter of the plurality of parameters by a weight factor selected based on an outcome of a nonlinear mapping using the activation function.

5. The method according to claim 1, wherein the method further comprises:

performing a second quality check, the second quality check comprising confirming a source rock potential of the predicted TOC based on the predicted sensitive elements; and calculating a net source rock thickness from confirmed TOC data with respect to corresponding depth points.

6. The method according to claim 1, wherein the sensitive elements are obtained from one or more of Pyrolysis Inductively Coupled Plasma-Mass Spectrometry (ICP-MS), x-ray fluorescence (XRF), and inorganic data.

7. The method according to claim 6, wherein the Pyrolysis, ICP-MS, XRF, inorganic data, and the first log data are collected from wells within the same geological setting.

8. The method according to claim 6, wherein the method further comprises: calculating a volume of hydrocarbon generated and expelled using the predicted TOC and the predicted sensitive elements.

9. A system for predicting total organic carbon (TOC) and sensitive elements related to unsampled intervals of a well, the system comprising:

a processor;

a non-transitory computer readable medium storing instructions that when executed by the processor cause the processor to perform a method comprising:

obtaining first log data related to sampled intervals of a well, the first log data comprising a plurality of parameters corresponding to one or more of TOC data and sensitive elements data associated with the sampled intervals;

generating a model representing a nonlinear relationship between the first log data and the TOC data and sensitive elements data using a machine learning engine;

obtaining second log data related to unsampled intervals of the well; and determining predicted TOC and predicted sensitive elements associated with the unsampled intervals of the well using the model and the second log data;

wherein the machine learning engine comprises an artificial neural network (ANN) comprising one or more hidden layers and a summation layer, and wherein the first log data is integrated with the TOC data and divided into a TOC calibration subset and a TOC validation subset, and wherein the first log data is integrated with sensitive elements data and divided into a sensitive elements calibration subset and a sensitive elements validation subset, and wherein the method further comprises training and optimizing the ANN using the TOC calibration subset, the TOC validation subset, the sensitive elements calibration subset, and the sensitive elements validation subset.

10. The system according to claim 9, wherein a sigmoid function or a Gaussian function is used as an activation function in the one or more hidden layers and a linear function is used in the summation layer.

11. The system according to claim 9, wherein the generating comprises an optimization process, the optimization process comprising:

determining an error value corresponding to a difference between a predicted TOC value and an actual TOC value or between a predicted sensitive element value and an actual sensitive element value; and in response to determining that the error value falls outside a pre-determined threshold, adjusting one or more learning parameters of the machine learning engine to reduce the error value.

12. The system according to claim 11, wherein the one or more learning parameters comprises at least one of a learning rate, a number of neurons, an activation function, and at least one weight factor of the machine learning engine, and wherein the model is generated by multiplying each parameter of the plurality of parameters by a weight factor selected based on an outcome of a nonlinear mapping using the activation function.

13. The system according to claim 9, wherein the method further comprises:

performing a second quality check, the second quality check comprising confirming a source rock potential of the predicted TOC based on the predicted sensitive elements; and calculating a net source rock thickness from confirmed TOC data with respect to corresponding depth points.

14. The system according to claim 9, wherein the sensitive elements are obtained from one or more of Pyrolysis Inductively Coupled Plasma-Mass Spectrometry (ICP-MS), x-ray fluorescence (XRF), and Inorganic data.

15. The system according to claim 14, wherein the Pyrolysis, ICP-MS, XRF, inorganic data, and the first log data are collected from wells within the same geological setting.

16. The system according to claim 14, wherein the method further comprises: calculating a volume of hydrocarbon generated and expelled using the predicted TOC and the predicted sensitive elements.

17. A method for predicting total organic carbon (TOC) and sensitive elements related to unsampled intervals of a well, the method comprising:

obtaining first log data related to sampled intervals of a well, the first log data comprising a plurality of parameters corresponding to one or more of TOC data and sensitive elements data associated with the sampled intervals;

generating a model representing a nonlinear relationship between the first log data and the TOC data and sensitive elements data using a machine learning engine;

obtaining second log data related to unsampled intervals of the well; and determining predicted TOC and predicted sensitive elements associated with the unsampled intervals of the well using the model and the second log data;

wherein a first quality check is performed on the TOC data, the first quality check comprising:

filtering the TOC data to remove values from contaminated samples by applying one or more of a hydrogen index, a production index, and an oxygen index as a filter to produce filtered TOC data, and confirming based on the sensitive elements data, a true source rock potential of the filtered TOC data.

18. The method according to claim 17, wherein the generating comprises an optimization process, the optimization process comprising:

determining an error value corresponding to a difference between a predicted TOC value and an actual TOC value or between a predicted sensitive element value and an actual sensitive element value; and in response to determining that the error value falls outside a pre-determined threshold, adjusting one or more learning parameters of the machine learning engine to reduce the error value.

19. The method according to claim 17, wherein the method further comprises:

performing a second quality check, the second quality check comprising confirming a source rock potential of the predicted TOC based on the predicted sensitive elements; and calculating a net source rock thickness from confirmed TOC data with respect to corresponding depth points.

20. A system for predicting total organic carbon (TOC) and sensitive elements related to unsampled intervals of a well, the system comprising:

a processor;

a non-transitory computer readable medium storing instructions that when executed by the processor cause the processor to perform a method comprising:

obtaining first log data related to sampled intervals of a well, the first log data comprising a plurality of parameters corresponding to one or more of TOC data and sensitive elements data associated with the sampled intervals;

generating a model representing a nonlinear relationship between the first log data and the TOC data and sensitive elements data using a machine learning engine;

obtaining second log data related to unsampled intervals of the well; and determining predicted TOC and predicted sensitive elements associated with the unsampled intervals of the well using the model and the second log data;

wherein the method further comprises performing a quality check on the TOC data, the quality check comprising:

filtering the TOC data to remove values from contaminated samples by applying one or more of a hydrogen index, a production index (PI), and an oxygen index as a filter to produce filtered TOC data, and confirming based on the sensitive elements data, a true source rock potential of the filtered TOC data.

* * * * *